United States Patent [19]

Watkinson

[11] 4,445,324

[45] May 1, 1984

[54] COLLAPSIBLE SPINNING MACHINE

[76] Inventor: James S. Watkinson, Nannup, Western Australia, Australia

[21] Appl. No.: 375,034

[22] PCT Filed: Aug. 25, 1981

[86] PCT No.: PCT/AU81/00122

§ 371 Date: Apr. 13, 1982

§ 102(e) Date: Apr. 13, 1982

[87] PCT Pub. No.: WO82/00667

PCT Pub. Date: Mar. 4, 1982

[30] Foreign Application Priority Data

Aug. 25, 1980 [AU] Australia ..... PE5216

[51] Int. Cl.[3] ..... D01H 3/00; D01H 1/04

[52] U.S. Cl. ..... 57/316

[58] Field of Search ..... 57/315, 316, 1 R; 112/217.1, 217.2, 217.3, 217.4, 258–260; 312/326–329

[56] References Cited

U.S. PATENT DOCUMENTS

| | | | |
|---|---|---|---|
| 224,700 | 2/1880 | Keisling et al. | 57/316 |
| 339,981 | 4/1886 | Fox | 57/316 |
| 557,110 | 3/1896 | Conner | 57/316 |
| 683,498 | 10/1901 | Richards | 112/217.1 |
| 958,800 | 5/1910 | Gibbins | 112/217.1 |
| 1,920,471 | 8/1933 | List et al. | 112/217.1 |
| 3,796,033 | 3/1974 | Oliver | 57/316 |

FOREIGN PATENT DOCUMENTS 507769 7/1979 Australia .

*Primary Examiner*—John Petrakes

*Attorney, Agent, or Firm*—Harness, Dickey & Pierce

[57] ABSTRACT

A manually operated spinning machine which is readily collapsible for transportation or storage. The spinning machine consists of a compartment which has an open front and a lid, the lid being movable between a closed position and an open position. A wheel is housed within the compartment for rotation in a vertical plane parallel to the front. A spinning head is mountable on the inside of the lid so that, when the lid is in the open position, the spinning head can be positioned with its pulley aligned with the wheel. A belt is provided for coupling the wheel and the pulley. Treadle means are connectable to the wheel through a crank for effecting rotation of the wheel.

21 Claims, 4 Drawing Figures

COLLAPSIBLE SPINNING MACHINE

This invention relates to a manually operated spinning machine.

Conventional manually operated spinning machines are rather cumbersome structures which are somewhat difficult to transport or store.

It is an object of this invention to provide a manually operated spinning machine which is readily collapsible for transportation or storage.

In one form the invention resides in a manually operated spinning machine comprising a compartment having an open front and a lid at the top, the lid being movable between a closed position and an open position, a wheel housed within the compartment for rotation in a vertical plane substantially parallel to the front, a spinning head having a pulley, the spinning head being mountable on the inside of the lid so that when the lid is in the open position the spinning head can be positioned with the pulley aligned with the wheel, a transmission element for operatively coupling the wheel and the pulley, when the pulley is aligned with the wheel and treadle means connectable to the wheel through a crank for effecting rotation of the wheel.

According to a preferred feature of the invention the lid is pivotally movable between said open and closed positions about a substantially horizontal axis parallel to the open front of the compartment.

According to a further preferred feature of the invention, the spinning head is pivotally and slidably mounted on the inside of the lid of the compartment so that when the lid is in the open position the spinning head can be positioned with the pulley in said alignment with the wheel and when in the closed position the spinning head is within the compartment.

According to a still further preferred feature of the invention, a door is provided at the open front of the compartment, the door being so shaped and so constructed that when in the open position the door is adapted to define the treadle means.

The invention will be better understood by reference to the following description of one specific embodiment thereof as shown in the accompanying drawings wherein:-

Figure 1:
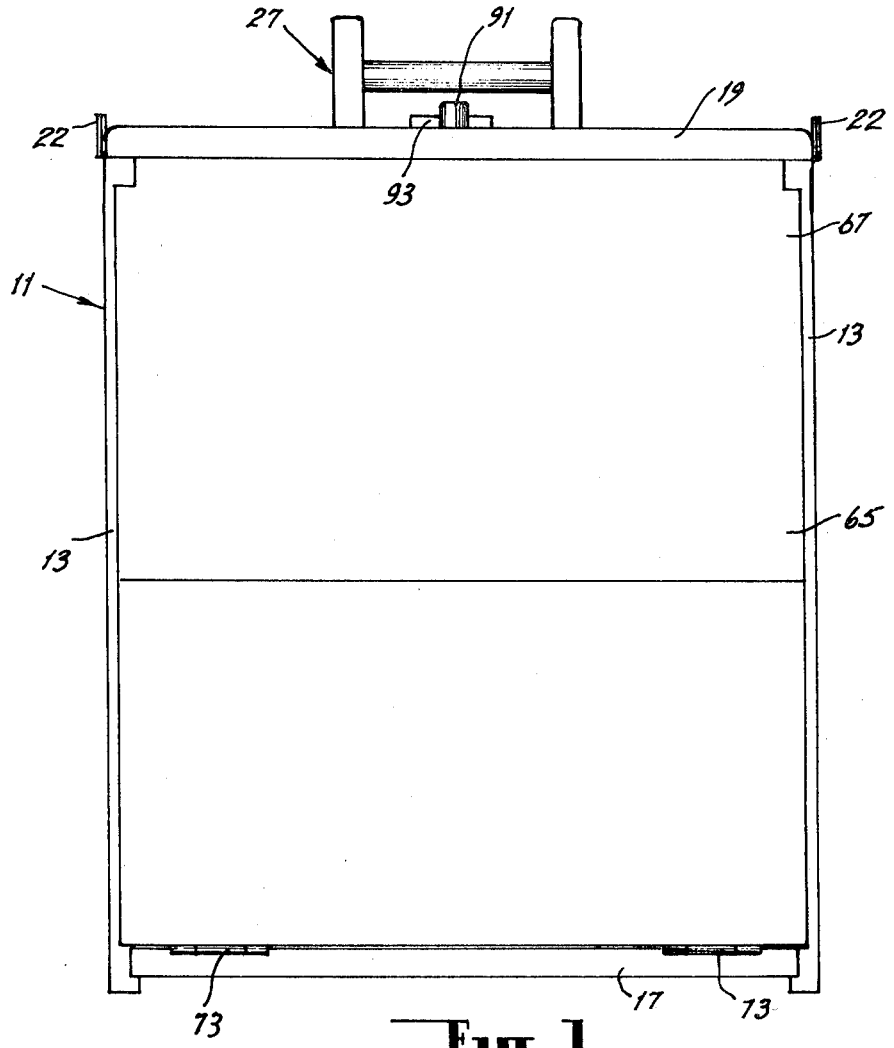
FIG. 1 is an elevational view of a spinning machine according to the embodiment in the collapsed condition.
Figure 2:
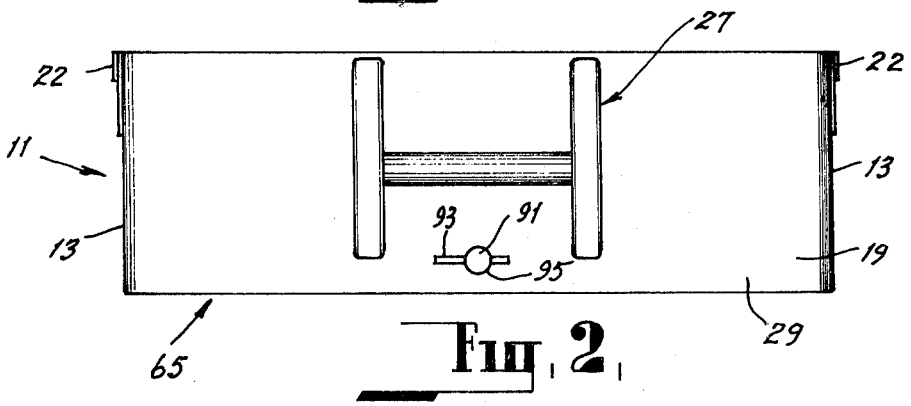
FIG. 2 is a plan view of the embodiment in the collapsed condition.
Figure 3:
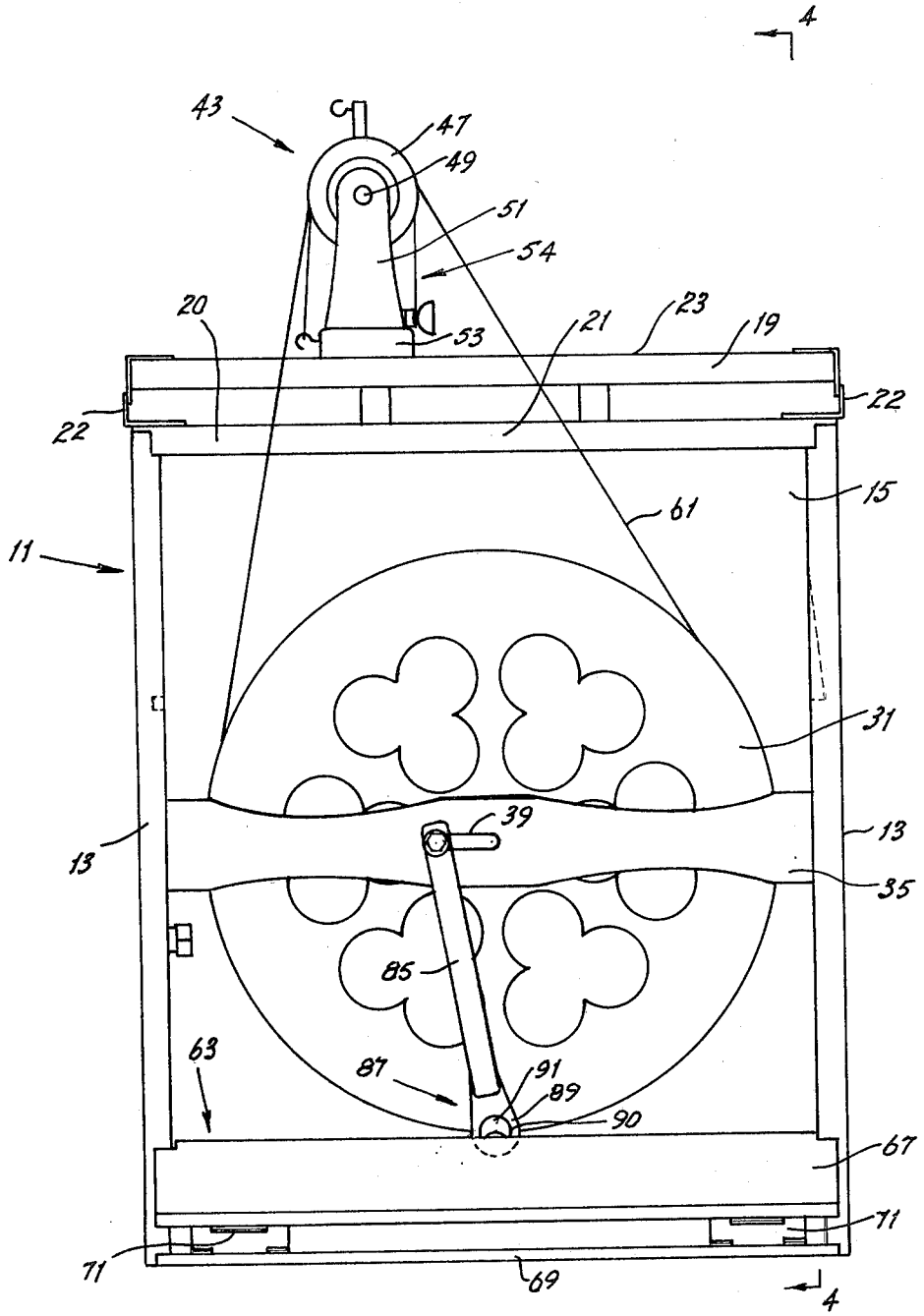
FIG. 3 is an elevational view of the embodiment in the operative condition.
Figure 4:
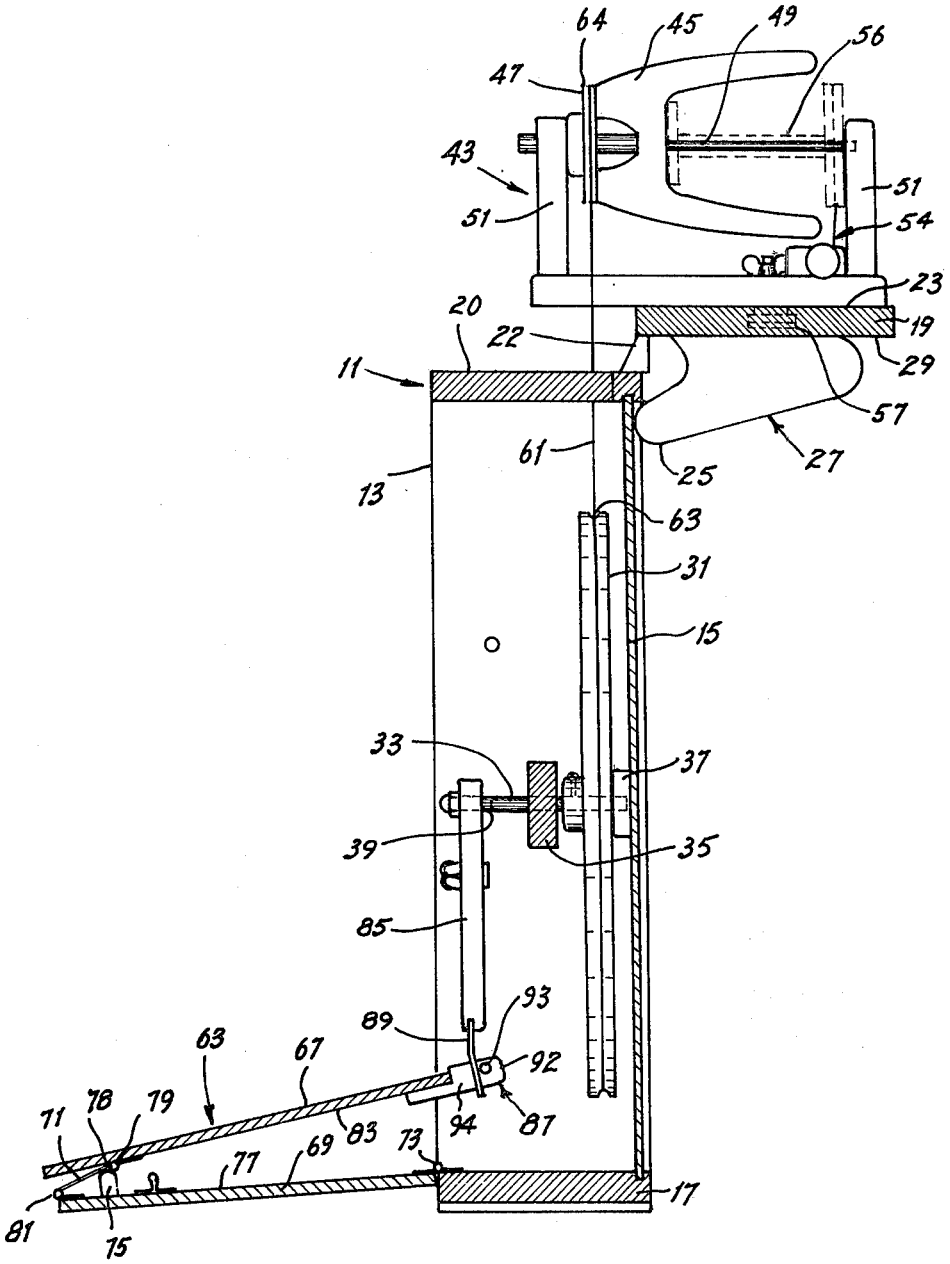
FIG. 4 is a section on the line 4—4 of FIG. 3.

The embodiment shown in the drawings is directed to a spinning machine for spinning or plying yarn, comprising a compartment 11 defined by a pair of side walls 13, a rear wall 15 a base 17 and a lid 19, the front of the compartment being open. A transverse member 20 extends between the side walls 13 at the uppermost end thereof to provide the compartment with structural rigidity. The transverse member is formed with a cut-out portion 21, the purpose of which will become apparent later. The lid 19 is hingedly mounted on the transverse member 20 by means of hinge members 22 for motion about a substantially horizontal axis and is movable between a closed position (as shown in FIGS. 1 and 2 of the drawings) in which the lid defines the top wall of the compartment and an open position (as shown in FIGS. 3 and 4 of the drawings) in which the lid 19 extends rearwardly from the rear wall 15 and in which the inside face 23 of the lid, which inside face is inside of the compartment when the lid is in the closed position, faces upwardly. A stop 25 is provided to limit pivotal movement of the lid 19 and thereby prevent movement of the lid beyond the open position, and to also stabilise the lid when in the open position. In the illustrated arrangement, the stop 25 is adapted to bear against the bear wall 15 when the lid is in the open position, and is formed integral with a carry handle 27 mounted on what is the outside face 29 of the lid when the lid is in the closed position. When the spinning machine is in the collapsed condition (as shown in FIGS. 1 and 2), the handle 27 enables the spinning machine to be readily carried.

A wheel 31 is housed within the compartment 11 for rotation in a vertical plane substantially parallel to the front of the compartment. More particularly, the wheel 31 is rigidly mounted on a crankshaft 33 which is in turn mounted for rotation about a substantially horizontal axis transverse to the plane of the front of the compartment. The crankshaft is journaled between a cross arm 35 which extends between the side walls 13 and a support 37 mounted on the rear wall 15. The crankshaft 33 does not extend outside of the compartment and carries a crank 39 at its end adjacent the open front of the compartment. The wheel 31 is formed with a plurality of cut-out portions 41 for weight reduction and decorative purposes.

A spinning head 43 is slidably and pivotally mounted on the inside face 23 of the lid. The spinning head 43 is of somewhat conventional design and includes a flyer 45 and a pulley 47 both being rigidly mounted on a spool carrying spindle 49 which is removably and rotatably supported between a pair of standards 51 on a base 53. The spinning head is provided with means 54 for restraining rotation of a spool 56, which is carried on the spindle 49, during a spinning or flying operation. The spinning head 43 is slidably and pivotally mounted onto the inside of the lid 19 by means of a mounting bolt 55 the head of which is slidably received in an elongate slot 57 formed in the lid 19. The longitudinal axis of the slot 57 is substantially parallel to the open front of the compartment and the slot is so shaped as to receive the head of the bolt in a manner whereby the bolt is restrained against axial movement while being slidable along the slot. In an alternative arrangement (not shown) the elongate slot 57 may extend completely through the lid, in which case the head of the mounting bolt would bear against the outside face 29 of the lid. The shank of the bolt is received in a mounting hole (not shown) formed in the base 53 of the spinning head 43, that portion of the shank which extends beyond the base being threadedly engaged by a nut 59 which is preferably a wing nut. With this arrangement the spinning head 43 can, when the lid is in the open position, be positioned with the pulley 47 aligned with the wheel 31, and with the axis of rotation of the pulley substantially parallel with that of the wheel. The spinning head is able to be clamped in such a position by tightening of the nut and bolt assembly. Further, on release of the nut and bolt assembly, the spinning head is able to be rotated relative to the lid into an inoperative position in which the longitudinal axis of the spindle 49 is generally parallel to the axis of rotation of the lid. With the illustrated arrangement, it is not possible for the lid to be moved into the closed position with the spinning head in said operative position because the length of the spinning head is greater than the depth of the compartment (as seen in FIG. 4). It is for this reason that it is necessary to move the spinning head into said inoperative position (at which position the spinning head is receivable within the compartment) before returning the lid to the closed position. The spinning head may be clamped in the inoperative position by means of the nut and bolt assembly. When the spinning head is in the inoperative position and the lid is returned to the closed position the spinning head is carried into the compartment, the cut-out portion 21 in the transverse member 20 being so shaped as to not impede the spinning head as it moves into the compartment. The spool carrying spindle 49, together with the pulley 47 and flyer 45 which are mounted on the spindle, may be removed from the spinning head and stored separately in the compartment if desired.

A belt 61 or like endless transmission element is provided for operatively coupling the wheel 31 and the pulley 47 when the pulley is aligned with the wheel as hereinbefore described. The belt 61 is received in circumferential grooves 63 and 64 formed in the respective peripheries of the wheel and the pulley. The belt may be tensioned and such tension may be varied by sliding movement of the spinning head relative to the lid as provided for by the elongated slot 57.

Treadle means 63 are connectable to the crank 39 of the crankshaft 33 for effecting rotation of the wheel 31. In the illustrated arrangement, the treadle means 63 is defined by a door 65 for the open front of the compartment. The door 65 comprises upper and lower door sections 67 and 69 respectively which are pivotally interconnected at or near their adjacent ends by one or more hinge members 71 (two being present in the illustrated arrangement). The lower door section 69 is pivotally mounted at 73 on the base 17 for rotation about a substantially horizontal axis parallel to the front of the compartment. The door 65 is movable between a closed position (as best seen in FIG. 1) in which it provides a closure for the open front of the compartment and an open position (as best seen in FIG. 4) in which it is adapted to constitute said treadle means 63. More particularly, when the door is in the open position the lower door section adopts an outwardly extending generally horizontal position with the upper door section disposed above and lying adjacent to the lower door section. A projection 75 is provided on the inside face 77 of the lower door section at a location inward of the end thereof fitted with the hinged connection 71 to define a fulcrum 78 about which the upper door section may be oscillated to effect the treadling action. The hinged connection 71 is adapted to accommodate the oscillatory motion of the upper door section relative to the lower door section. This is achieved, in this embodiment, by providing the hinged connection 71 with a pair of pivotal axes 79 and 81, one of which lies closely adjacent the inside face 83 of the upper door section 67 and is arranged to co-operate with the fulcrum 78, and the other of which lies closely adjacent the inside face 77 of the lower door section 69.

The end of the upper door section 67 remote from the hinged connection 71 is adapted for connection to one end of a connecting rod 85 through universal joint means 87 to permit relative rotation therebetween about a pair of mutually perpendicular axes. The other end of the connecting rod is pivotally mounted on the crank 39 of the crankshaft 33. The universal joint means 87 in this embodiment comprises a flexible member 89, formed from suitable material such as leather, attached at one end to the connecting rod and having an aperture 90 formed therein to receive a spigot 91 extending from the end of the upper door section remote from the hinged connection. The spigot is substantially circular in cross-section and its central longitudinal axis is substantially perpendicular to the axis about which the upper door section 67 oscillates during treadling motion. The aperture formed in the flexible member 89 is so dimensioned that the flexible member is capable of oscillatory motion relative to the spigot when the spigot is received therein and the upper door section oscillated. A transverse hole 92 is formed in the spigot 91 adjacent the free end thereof to receive a removable pin 93 or like locking element. The pin 93, when in position in the spigot 91, prevents withdrawal of the spigot from within the aperture. It should be appreciated that any other suitable means may be provided for releasably retaining the spigot in the aperture.

Referring now to FIGS. 1 and 2, the spigot 91 is also receivable in an aperture 95 formed in the lid 19, when the lid and the door 65 are in their respective closed positions. The pin 93 is again receivable in the transverse hole 92 to retain the spigot in position and thereby in effect lock the door 65 and the lid 19 in their respective closed positions.

The compartment 11 is preferably provided with means (not shown) for storing additional spools and spinning accessories when the spinning machine is in the collapsed condition.

With the spinning in the collapsed condition (as shown in FIGS. 1 and 2), the door 65 and the lid 19 are in their respective closed positions and the spinning head 43 is accommodated within the compartment 11, the spinning head being mounted on the inside 23 of the lid 19. When in the collapsed condition, the spinning machine may be readily carried by means of the handle 27.

The spinning machine according to the embodiment is assembled into the operative condition (as shown in FIGS. 3 and 4) by firstly opening the door 65 and lid 19. As the lid moves towards the open position, the spinning head 43 is carried out of the compartment 11. After release of the clamping force applied to the spinning head by the nut and bolt assembly, the spinning head is moved relative to the lid from its inoperative position in which the longitudinal axis of the spindle 49 is generally parallel to the axis of rotation of the lid into its operative position in which the axis of rotation of the spindle 49 is parallel to the rotational axis of the crankshaft 33 and the pulley 47 is in alignment with the wheel. The belt 61 may then be fitted around the pulley 47 and the wheel 31 and tensioned by sliding the spinning head relative to the lid as provided for by the elongated slot 57. When the belt 61 is at the desired tension, the spinning head is locked in position relative to the lid by means of the bolt and nut assembly. The treadle means 63 is assembled by rotational positioning of the upper door section 67 relative to the lower door section 69 so that it lies above and adjacent the lower door section when the latter is supported at its outer end on the surface on which the spinning machine is standing. The spigot 91 is inserted into its aperture 90 in the flexible member 89 and the pin 93 inserted in position, thereby forming the universal joint means 87 which couples the treadle means to the connecting rod 85. At this stage, the spinning machine is in its operative condition and ready for operation, apart from the usual setting-up operations required for spinning wheels, such as placement of a spool 56 on the spinning head 43 and threading of yarn through the spindle 49, around the flyer 45 and onto the spool. The spinning machine can then be operated in the convention manner.

The spinning machine is returned to the collapsed condition by reversal of the assembly steps.

It should be appreciated that the scope of the invention is not limited to the scope of the embodiment described. In an alternative arrangement, for example, the spinning head may be readily detachable from the lid in which case the spinning head may be stored in the compartment in a condition separate from the lid when the lid is in the closed position, and be adapted for mounting onto the inside of the lid when the lid is in the open position.

Further, it is not essential that the treadle means be formed by the door 65 when the door in its open position. The treadle means may, for example, be independent of the door and pivotally mounted onto the base of the compartment for movement between an operative position in which the treadle means is outwardly extending from the compartment and an inoperative position in which the treadle means is housed within the compartment. In such a case, the door may be hinged to one of the side walls of the compartment for motion about a substantially vertical axis so as to be movable into an open position clear of the front of the compartment; in this way the door when in the open position would not restrict operation of the treadle means.

In a still further arrangement, means may be provided for providing the spinning machine with increased stability when in the assembled condition. Such means may comprise an arm or the like extendible rearwardly from the compartment when the machine is in the assembled condition and adapted to be on the surface on which the spinning machine is standing.

THE CLAIMS defining the invention are as follows:-

I claim:

1. A manually operated spinning machine comprising a compartment having an open front and a lid at the top, the lid being movable between a closed position and an open position, a wheel housed within the compartment for rotation in a vertical plane substantially parallel to the front, a spinning head having a pulley, the spinning head being mountable on the inside of the lid so that when the lid is in the open position the spinning head can be positioned with the pulley aligned with the wheel, a transmission element for operatively coupling the wheel and the pulley when the pulley is aligned with the wheel, and treadle means connectable to the wheel through a crank for effecting rotation of the wheel.

2. A mannually operated spinning machine as claimed in claim 1 wherein the lid is pivotally movable between said open and closed positions about a substantially horizontal axis parallel to the open front of the compartment.

3. A manually operated spinning machine as claimed in claim 2 wherein the lid when in said open position extends rearwardly of the compartment with said inside face facing upwardly.

4. A manually operated spinning machine as claimed in any one of the preceding claims wherein the spinning head is pivotally and slidably mounted on the inside of the lid so that when the lid is in the open position the spinning head can be positioned with the pulley in said alignment with the wheel and when in said closed position the spinning head is within the compartment.

5. A manually operated spinning machine as claimed in claim 4 wherein said slidable and pivotal mounting of the spinning head on the lid is effected by a mounting bolt slidably received in an elongated slot form in the lid, the longitudinal axis of the slot being parallel to the plane within which the wheel rotates, said mounting bolt being received also in an aperture formed in the spinning head, and the free end of the mounting bolt being threadedly engaged by a nut.

6. A manually operated spinning machine as claimed in claim 5 wherein the spinning head is movable between an operative position in which the axis of rotation of the pulley is substantially parallel to the rotational axis of the wheel and an inoperative position in which the axis of rotation of the pulley is generally transverse to the rotational axis of the wheel, the spinning head being in said inoperative position when in the compartment.

7. A manually operated spinning machine as claimed in claim 6 wherein a door is provided for the open front of the compartment, the door being movable between an open position and a closed position and being so shaped and so constructed that when in the open position it is adapted to constitute said treadle means.

8. A manually operated spinning machine as claimed in claim 7 wherein the door comprises upper and lower door sections pivotally interconnected at or near their adjacent ends, the lower door section being pivotally mounted at its other end on the compartment for rotation about a substantially horizontal axis parallel to the front of the compartment, wherein when the door is in said open position the lower door section adopts an outwardly extending generally horizontal position and the upper door section is disposed above and lies adjacent the lower door section, and wherein there is provided a fulcrum about which the upper door section may be oscillated relative to the lower door section to effect treadling motion.

9. A manually operated spinning machine as claimed in claim 8 wherein said fulcrum is defined by a projection on the inside face of the lower door section at a location inward of the end thereof pivotally connected to the upper door section, said pivotal connection between the upper and lower doors sections being adapted to accommodate said oscillatory motion of the upper door section relative to the lower door section.

10. A manually operated spinning machine as claimed in claim 9 wherein the end of the upper door section remote from the hinged connection to the lower door section is adapted for connection to one end of a connecting rod through a universal joint means, the other end of the connecting rod being pivotally coupled to said crank.

11. A manually operated spinning machine as claimed in claim 10 wherein said universal joint means comprises a flexible member attached to the connecting rod, the flexible member being formed with an aperture adapted to receive a spigot extending from the upper door section and means for releasably retaining the spigot in the aperture, the aperture being so dimensioned that the flexible member is capable of oscillatory motion relative to the spigot when the spigot is received therein and the upper door section oscillated.

12. A manually operated spinning machine as claimed in claim 11 wherein the spigot is substantially circular in cross-section and the central longitudinal axis thereof is substantially perpendicular to the axis about which the upper door section oscillates during treadling motion.

13. A manually operated spinning machine as claimed in claim 12 wherein said means for releasably retaining the spigot in said aperture comprises a locking pin or the like adapted to be received in a transverse hole formed in the spigot adjacent the free end thereof.

14. A manually operated spinning machine as claimed in claim 13 wherein said spigot is receivable in an aperture formed in the lid when the lid and the door are in their respective closed positions, and wherein there is provided means for retaining the spigot in said aperture to lock the door and the lid in their respective closed positions.

15. A manually operated spinning machine as claimed in claim 14 wherein said spigot retaining means comprises said locking pin or the like receivable in said transverse hole.

16. A manually operated spinning machine as claimed in any one of claims 1 to 3 wherein the treadle means is pivotally mounted on the compartment and is pivotable between an operative position in which the treadle means is outwardly extending from the compartment and an inoperative position in which the treadle means in within the compartment.

17. A manually operated spinning machine as claimed in claim 16 wherein the compartment is defined by a pair of side walls, a base, a rear wall and said lid.

18. A manually operated spinning machine as claimed in claim 17 wherein a stop is provided for limiting pivotal movement of the lid at said open position.

19. A manually operated spinning machine as claimed in claim 18 wherein said stop is adapted to bear against the rear wall of the compartment.

20. A manually operated spinning machine as claimed in claim 19 wherein the stop is integral with a carry handle mounted on the outside face of the lid.

21. A manually operated spinning machine as claimed in claim 20 wherein the spinning head comprises a spool carrying spindle onto which said pulley and a flyer are rigidly mounted, the spool carrying spindle being releasably and rotatably supported between a pair of standards mounted on a base and means provided for restraining rotation of a spool mounted on the spool carrying spindle.

* * * * *